US009306329B2

(12) United States Patent
Hashimoto

(10) Patent No.: US 9,306,329 B2
(45) Date of Patent: Apr. 5, 2016

(54) LEVER-TYPE CONNECTOR

(71) Applicant: Sumitomo Wiring Systems, Ltd., Yokkaichi, Mie (JP)

(72) Inventor: Norihito Hashimoto, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 14/254,982

(22) Filed: Apr. 17, 2014

(65) Prior Publication Data

US 2014/0370733 A1 Dec. 18, 2014

(30) Foreign Application Priority Data

Apr. 18, 2013 (JP) ..... 2013-087069

(51) Int. Cl.
*H01R 13/62* (2006.01)
*H01R 13/629* (2006.01)

(52) U.S. Cl.
CPC ..... *H01R 13/62938* (2013.01)

(58) Field of Classification Search
CPC ..... H01R 13/5219; H01R 13/5202; H01R 13/62933; H01R 13/62938; H01R 13/62955; H01R 13/631; H01R 13/6275
USPC ..... 439/157, 271, 910, 595, 372, 160
See application file for complete search history.

(56) References Cited

U.S. PATENT DOCUMENTS 5,437,564 A 8/1995 Lignelet
6,354,852 B2 * 3/2002 Noro et al. ..... 439/157
6,413,105 B2 * 7/2002 Noro et al. ..... 439/157
6,544,054 B2 * 4/2003 Ishikawa et al. ..... 439/157
7,303,437 B2 * 12/2007 Nishide ..... 439/595
2005/0221673 A1 10/2005 Myer et al.

FOREIGN PATENT DOCUMENTS

JP 2004079377 3/2004
JP 2008112662 5/2008

OTHER PUBLICATIONS

European Patent Appl. No. 12 84 0747—European Search Report issued Apr. 23, 2015.

* cited by examiner

*Primary Examiner* — Amy Cohen Johnson
*Assistant Examiner* — Milagros Jeancharles
(74) *Attorney, Agent, or Firm* — Gerald E. Hespos; Michael J. Porco; Matthew T. Hespos

(57) ABSTRACT

A lever-type connector has a housing (20) and shafts (33) project from opposite side surfaces of the housing (20). Outward deformation preventing walls (35) define open inner spaces (37) on sides of the shafts (33). A U-shaped lever (60) has a coupling (61) and two arm plates (62). The arm plates (62) are mounted on the shafts (33) for rotation between an initial position and a connection position. Each arm plate (62) includes a thin portion (66) and a thick portion (68). The thin portions (66) of the arm plates (62) deform out due to interference with the shafts (33) and enter the inner spaces (37) of the outward deformation preventing walls (35) of the housing (20) at the assembled position. The thick portions (67) of the arm plates (62) enter the inner spaces (37) of the outward deformation preventing walls (35) when moving toward the connection position.

11 Claims, 10 Drawing Sheets

LEVER-TYPE CONNECTOR

BACKGROUND

1. Field of the Invention

The invention relates to a lever-type connector.

2. Description of the Related Art

U.S. Pat. No. 6,544,054 discloses a lever-type connector with a housing that is connectable to a mating housing and a lever rotatably mounted on the housing. Shafts project from opposite sides of the housing and outward deformation preventing walls are provided outward of the shafts with open inner spaces on the sides of the shafts. The lever has two arm plates and a coupling connects the arm plates to define a U-shape. Each arm plate has a bearing hole for receiving the shaft and a cam groove to engage a cam pin of the mating housing.

The arm plates deform out when the lever is mounted due to interference with the shafts. The shafts then fit resiliently into the bearing holes of the arm plates to support the lever rotatably on the shafts. The lever is rotated while the cam pins engage the cam grooves of the arm plates and a connecting operation of the housings proceeds due to a force multiplying action exhibited by rotating the lever. The arm plates may deform out due to a connecting force on the lever in the process of connecting the housings. However, the arm plates contact the outward deformation preventing walls to limit outward deformation of the arm plates and to prevent the arm plates from inadvertently being detached from the shafts. More particularly, thinned portions of the arm plates contact thickened portions of the outward deformation preventing walls. Thus, the rigidity of the outward deformation preventing walls is ensured and overlapping parts of the arm plates and the outward deformation preventing walls are not excessively thick.

Clearances between the arm plates and the outward deformation preventing walls are narrow. Thus, the arm plates may press the outward deformation preventing walls when the arm plates are deflected to mount on the shafts and mounting resistance may be excessive. Assembly is easier if the arm plates are thinned to widen clearances between the arm plates and the outward deformation preventing walls. However, the arm plates may detach from the shafts if excessive outward deformation of the arm plates is allowed.

The invention was completed in view of the above situation and aims to provide a connector with an easily mounted lever that offers high operational reliability.

SUMMARY OF THE INVENTION

The invention relates to a lever-type connector with a housing that is connectable to a mating housing. Shafts project from opposite side surfaces of the housing and outward deformation preventing walls define open inner spaces on the sides of the shafts. The connector also has a lever with two arm plates projecting from opposite ends of a coupling to define a U-shape. The arm plates are mounted on the shafts to permit rotation of the lever between an initial position and a connection position. More particularly, the arm plates deform out during mounting due to interference with the shafts, but then return resiliently to fit on the shafts. Thus, the arm plates are accommodated in the inner spaces of the outward deformation preventing walls with the lever straddling the housing when the arm plates are assembled on the shafts. The arm plates can engage the mating housing at the initial position of the lever. The lever then is rotated from the initial position toward the connection position while keeping an engaged state. The lever exhibits a force multiplying action that urges the housing together with the mating housing. Each arm plate has a thin portion that enters the inner space of the outward deformation preventing wall at the assembled position and a thick portion that enters the inner space of the outward deformation preventing wall as the lever moves toward the connection position and contacts the outward deformation preventing wall when the arm plate is deformed excessively out.

The thin portions of the arm plates enter the inner spaces of the outward deformation preventing walls at the assembled position. Thus, sufficient escaping space for each arm plate is ensured when the arm plates deform out due to interference with the shafts. Thus, sliding resistance due to the interference of the arm plates and the outward deformation preventing walls does not become excessive and assembly is improved.

On the other hand, the thick portions of the arm plates enter the inner spaces of the outward deformation preventing walls in the process of moving the arm plates from the initial position toward the connection position. Thus, the thick portions reliably contact the outward deformation preventing walls to prevent outward detachment of the arm plates from the shafts when the arm plates deform out due to a connecting force of the housings.

The assembled position and the initial position are set at positions different from each other. Thus, the thick portions of the arm plates will not enter erroneously into the inner spaces of the outward deformation preventing walls at the assembled position.

A ratio of the thin portion in the entire arm plate is larger than that of the thick portion. This can reduce material cost for the arm plates and realize a weight reduction.

The thick portion is provided along an outer peripheral edge of the arm plate to ensure rigidity of the outer peripheral parts of the arm plates.

DETAILED DESCRIPTION OF THE PREFERRED EMBODIMENTS

One embodiment of the invention is described with reference to FIGS. 1 to 10. A lever-type connector 10 of this embodiment includes a housing 20 connectable to a mating housing 90 and a lever 60 rotatably mounted on the housing 20.

Figure 4:
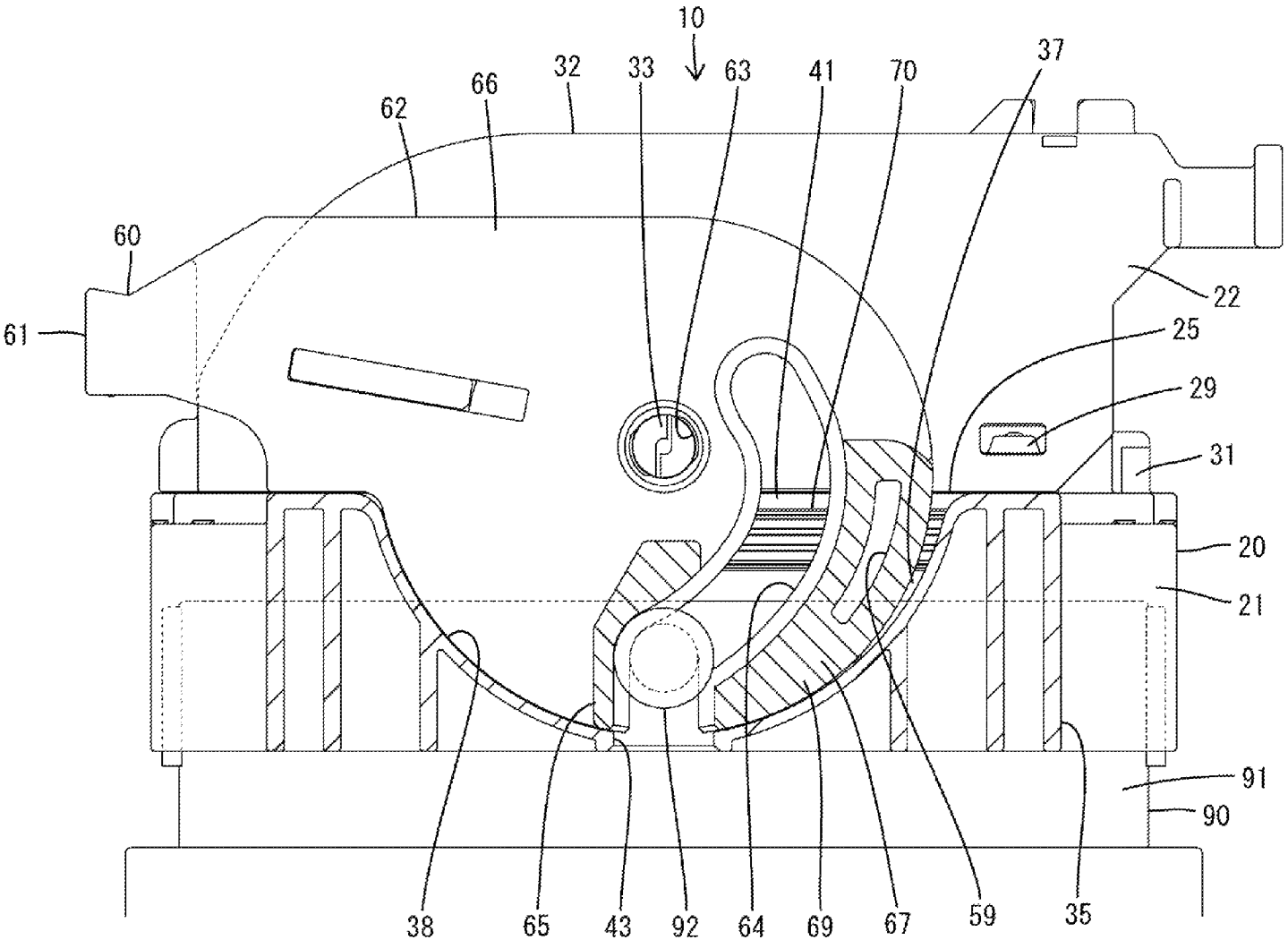
FIG. 4 is a plan view, partly in section, showing the lever at the initial position.

The mating housing 90 is made of synthetic resin and includes a receptacle 91 substantially in the form of a wide rectangular tube, as schematically shown in FIG. 4. Two follower pins 92 project on the outer surfaces of opposite longer side walls of the receptacle 91. Each follower pin 92 is substantially cylindrical and is arranged substantially in a widthwise center of a front end part of the outer surface of each of the opposite side walls. Unillustrated male tabs project in the receptacle 91.

Figure 3:
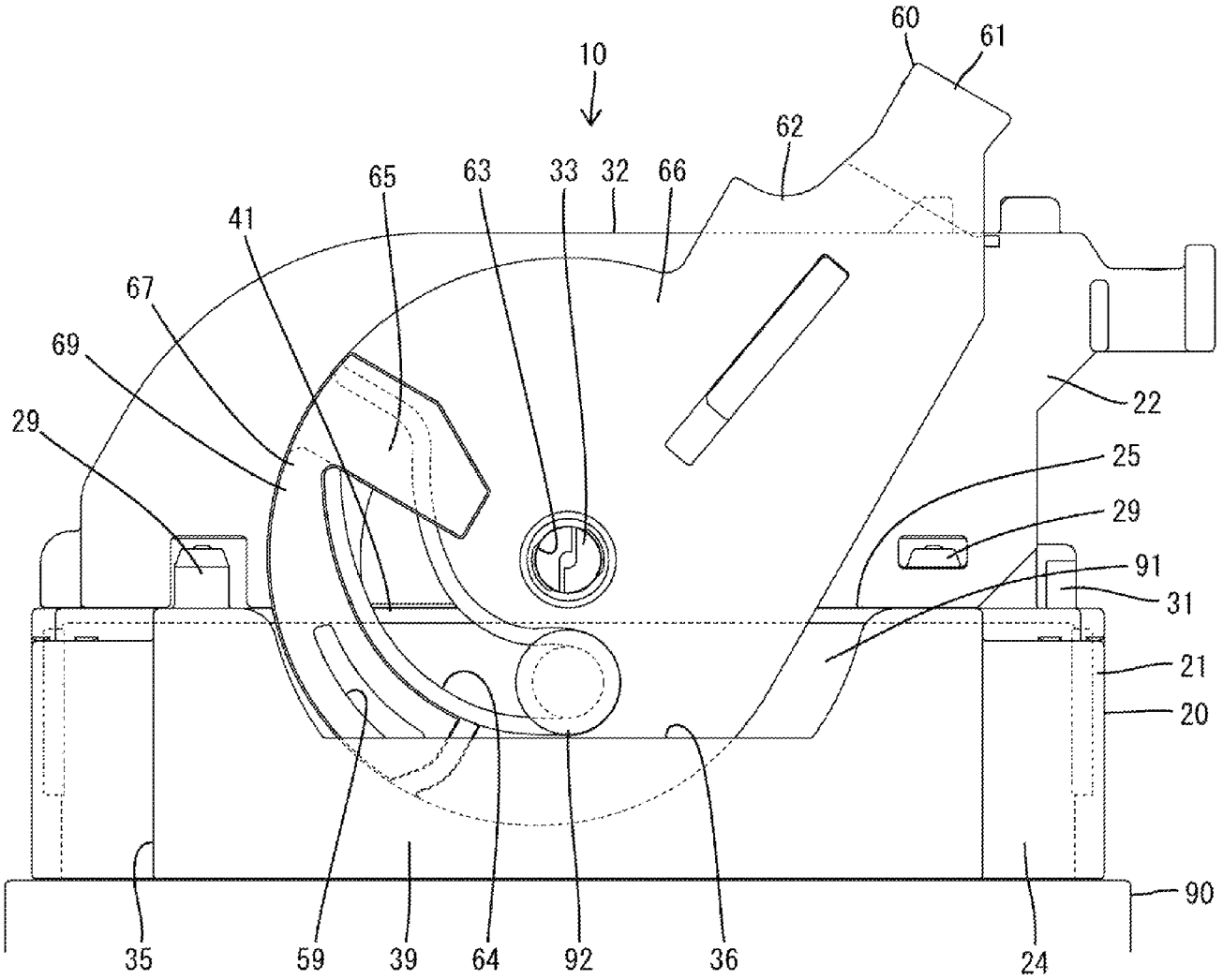
FIG. 3 is a plan view showing a state where the lever is at a connection position.
Figure 7:
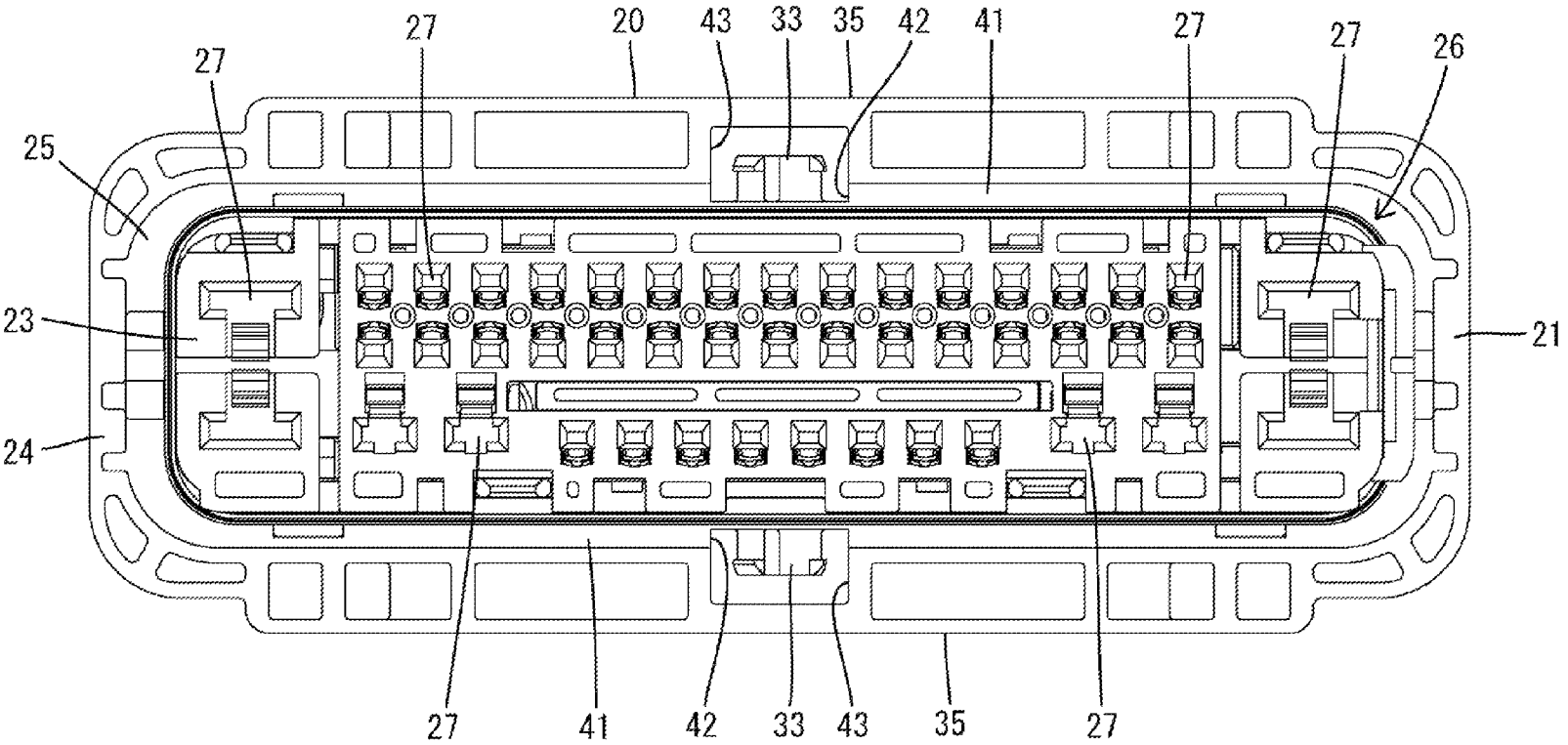
FIG. 7 is a front view of the housing.

As shown in FIG. 3, the housing 20 is made of synthetic resin and includes a housing main body 21 and a wire cover 22. As shown in FIG. 7, the housing main body 21 includes a wide substantially rectangular block-shaped terminal accommodating portion 23 and a wide substantially rectangular fitting tube 24 surrounds the outer periphery of the terminal accommodating portion 23. A radially extending linking wall 25 links the fitting tube portion 24 and the terminal accommodating portion 23. A forwardly open connection space 26 is before the linking wall 25 and between the fitting tube 24 and the terminal accommodating portion 23 for receiving the receptacle 91 of the mating housing 90.

Cavities 27 are provided in the terminal accommodating portion 23, as shown in FIG. 7, and an unillustrated terminal fitting is inserted into each cavity 27 from behind. Each terminal fitting is crimped to an end of an unillustrated wire and is connected electrically conductively to a corresponding male tab when the housings 20, 90 are connected.

Figure 2:
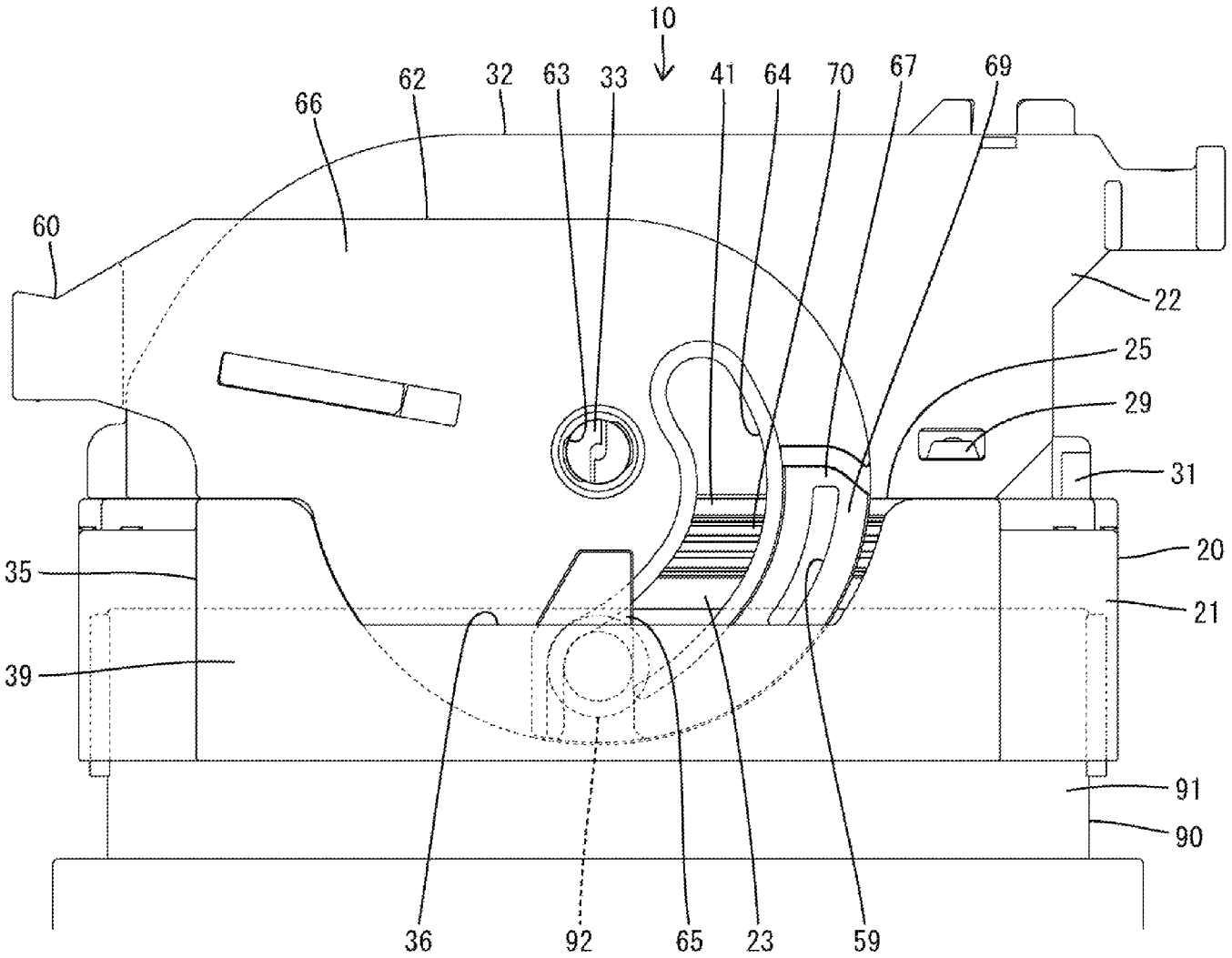
FIG. 2 is a plan view showing a state where the lever is at an initial position.
Figure 6:
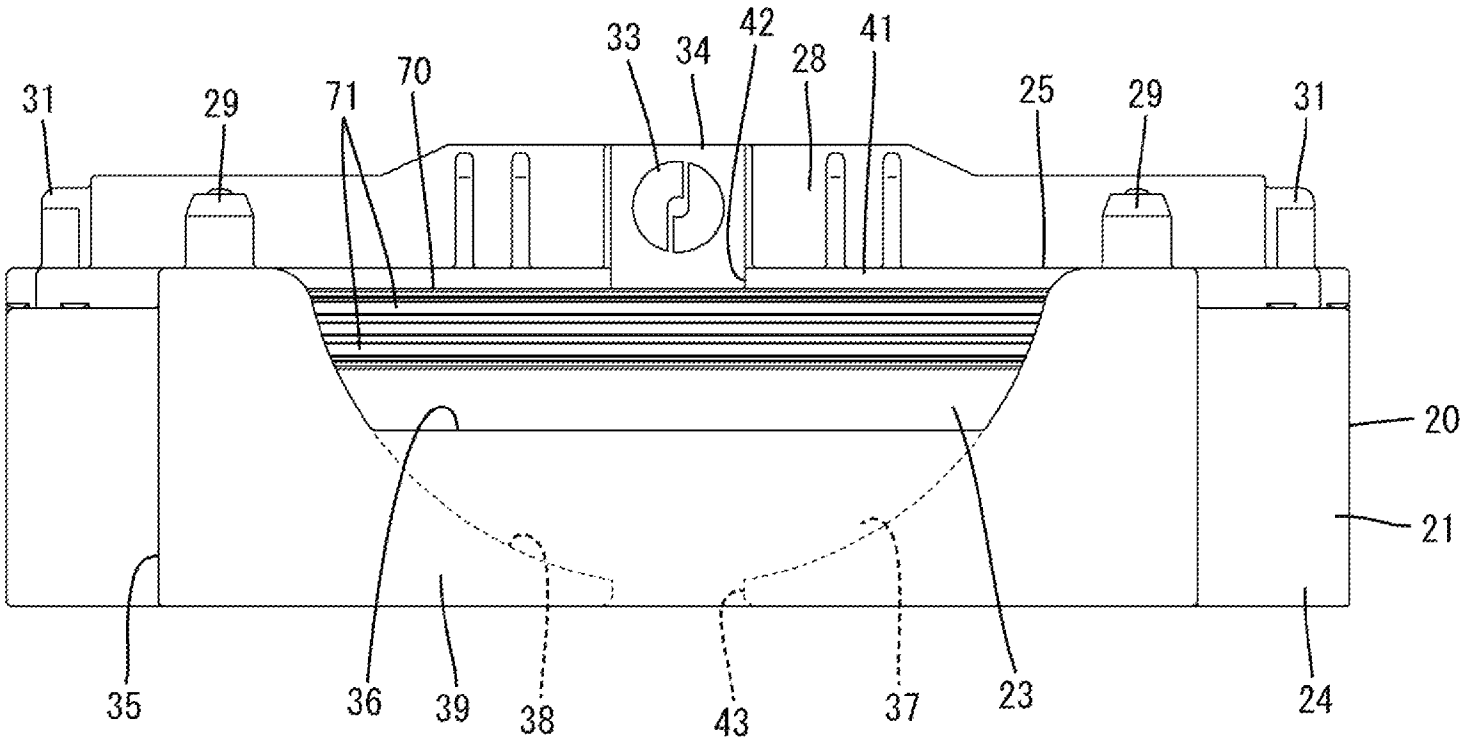
FIG. 6 is a plan view of a housing.

The linking wall 25 radially bulges out from the outer peripheral surface of the housing main body 21 and is arranged so that the wire cover 22 can contact the rear surface of the linking wall 25 from behind, as shown in FIG. 2. A rear end part 28 of the housing main body 21 projects back from the rear surface of the linking wall 25, as shown in FIG. 6, and two lateral cover locks 29 extend back from the rear surface of the linking wall 25 near opposite widthwise ends of each opposite longer side surface of the rear end part 28. Two end cover locks 31 extend back from the rear surface of the linking wall 25 on opposite shorter side surfaces of the housing main body 21.

The wire cover 22 is made of synthetic resin and defines a cap that is open forward and on the right side in FIG. 2. The wire cover 22 covers the rear end part 28 of the housing main body 21 and is in contact with the rear surface of the linking wall 25. An end edge on left side in FIG. 2 is locked by the end cover lock 31 and the side surfaces on the one widthwise side are locked by the lateral cover locks 29 to hold the wire cover 22 on the housing main body 21. The end cover locks 31 and the lateral cover locks 29 are paired on opposite left and right sides so that the wire cover 22 can be locked in either of two opposite orientations. Wires drawn out from the rear surface of the housing main body 21 are accommodated in the wire cover 22 and are bent along a back plate 32 of the wire cover 22 to be pulled out to the outside through the opening on the one widthwise side.

As shown in FIGS. 6 and 7, two shafts 33 are provided in substantially widthwise centers of opposite side surfaces of the rear end part 28 of the housing main body 21. Each shaft 33 is substantially cylindrical and projects on a base 34 having a substantially rectangular plan view, as shown in FIG. 6. Two outward deformation preventing walls 35 are provided on parts of the fitting tube 24 facing the opposite side surfaces of the housing main body 21. Each outward deformation preventing wall 35 bulges outward and includes an escaping portion 36 formed by recessing the rear edge thereof and not linked to the linking wall 25. As shown in FIG. 4, an inner space 37 capable of accommodating an arm plate 62 of the lever 60 is open backward at an inner side of the outward deformation preventing wall 35. The inner space 37 is bordered by a substantially arcuate peripheral surface portion 38, as shown in FIG. 4, and an outer side thereof is closed by a covering wall 39 as shown in FIG. 6. A part corresponding to the escaping portion 36 out of the rear edge of the covering wall 39 extends straight along the width direction.

As shown in FIG. 6, the linking wall 25 has two continuous walls 41 extending along the width direction behind the escaping portions 36 of the respective outward deformation preventing walls 35. Two cut recesses 42 are formed at positions facing the shafts 33 substantially in widthwise centers of the respective continuous walls 41. Further, two introducing recesses 43 are formed at positions facing the shafts 33 substantially in widthwise centers of the respective outward deformation preventing walls 35. The follower pins 92 of the mating housing 90 can enter the respective introducing recesses 43 from the front when the connection of the two housings 20, 90 is started (see FIG. 4).

As shown in FIG. 7, the shafts 33 can be seen from front through the cut recesses 42 and the introducing recesses 43, and front surface parts of the shafts 33 are formed together with the cut recesses 42 and the introducing recesses 43 by pulling out an unillustrated mold forward. Further, the shafts 33 are exposed to the rear side and opposite widthwise sides in addition to the front.

As shown in FIG. 6, a seal ring 70 is mounted on the outer periphery of the terminal accommodating portion 23 of the housing main body 21. The seal ring 70 is made of rubber, such as silicon rubber, and closely contacts the entire outer peripheral surface of the terminal accommodating portion 23. Outer lips 71 are formed circumferentially on the outer peripheral surface of the seal ring 70 and are juxtaposed in a front-back direction. Further, unillustrated inner lips are formed circumferentially on the inner peripheral surface of the seal ring 70 and are juxtaposed in the front-back direction. The seal ring 70 is mounted onto the outer peripheral surface of the terminal accommodating portion 23 from the front and contacts the front surface of the linking wall 25. When the two housings 20, 90 are connected, each inner lip is held resiliently in close contact with the outer peripheral surface of the housing main body 21 and each outer lip 71 is held resiliently in close contact with the inner peripheral surface of the receptacle 91. Thus, the seal ring 70 is compressed resiliently between the two housings 20, 90 to provide sealing between the two housings 20, 90. Note that the seal ring 70 is a different color from the housing 20 and the lever 60 to have good visibility.

Figure 8:
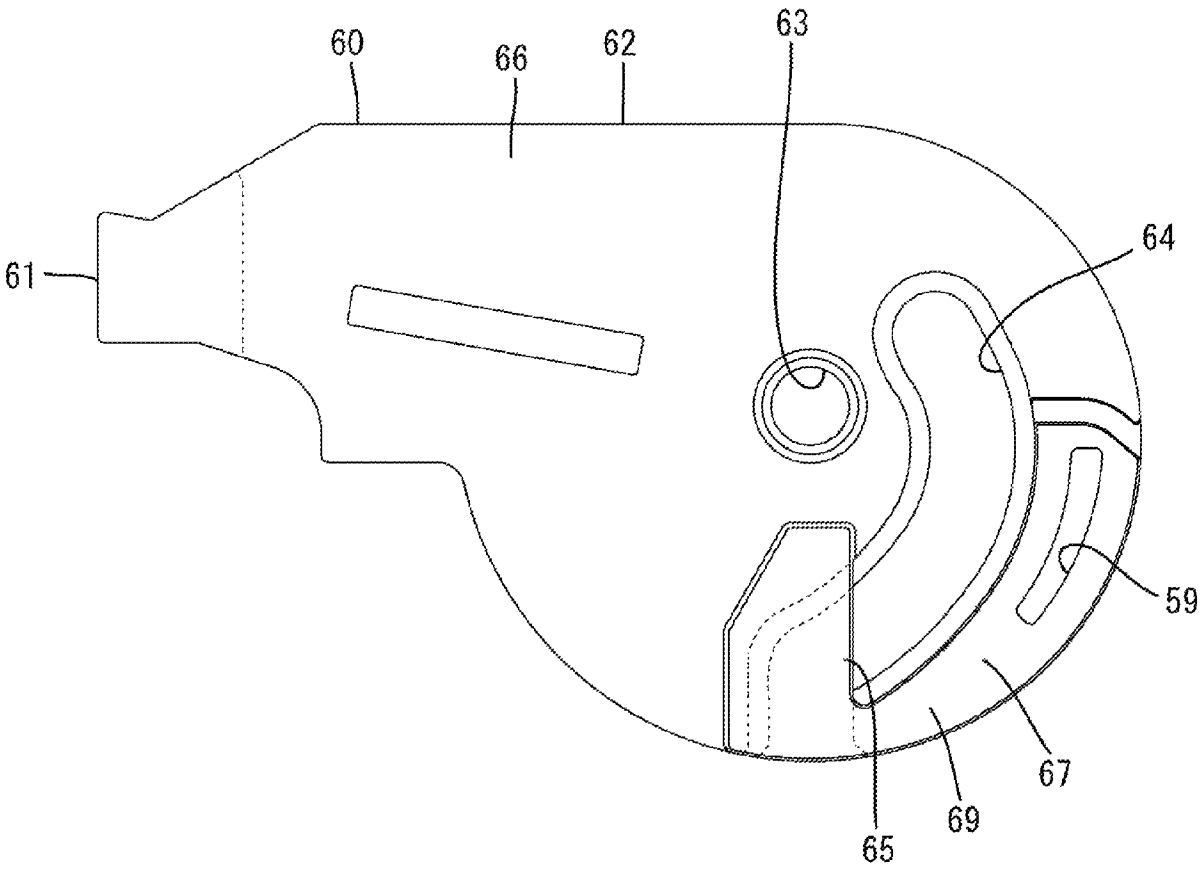
FIG. 8 is a plan view of the lever.
Figure 9:
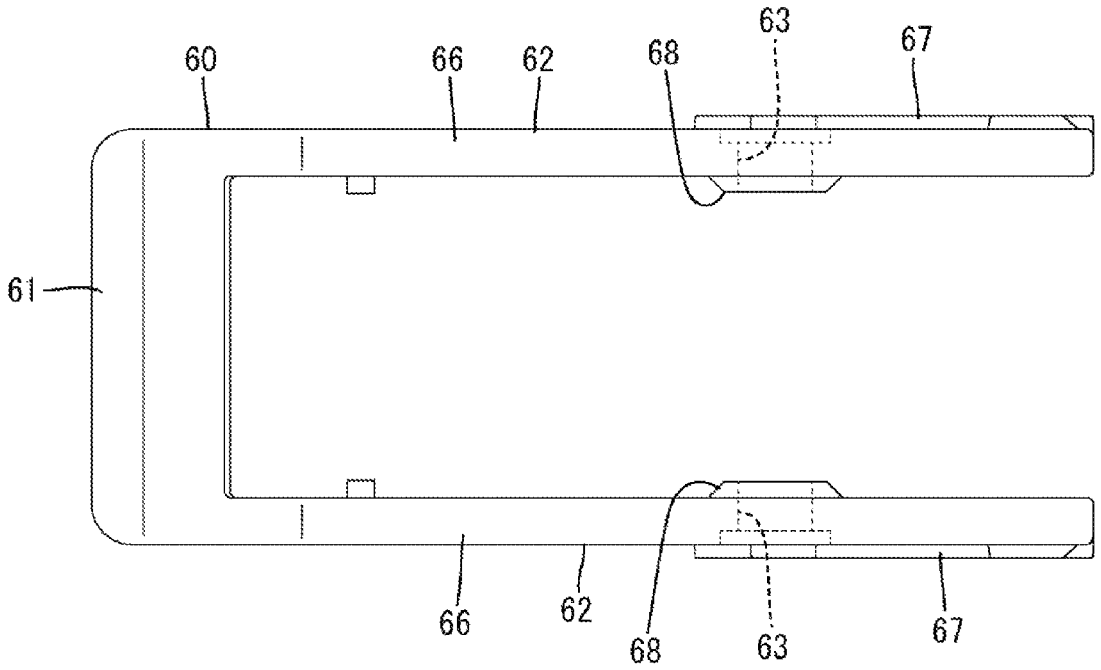
FIG. 9 is a rear view of the lever.

The lever 60 is made of synthetic resin and, as shown in FIG. 9, includes a coupling 61 extending along a height direction and two arm plates 62 projecting in the width direction substantially in parallel with each other from opposite ends of the coupling 61 in the height direction to define a U-shape. A bearing hole 63 penetrates each arm plate 62. As shown in FIG. 8, each arm plate 62 has a curved cam groove 64 that opens on the outer periphery edge of the arm plate 62. Each cam groove 64 penetrates through the arm plate 62 in a plate thickness direction except at an entrance part open on the outer peripheral edge of the arm plate 62. A bridge 65 covers the entrance part of the cam groove 64 on the outer surface of an outer peripheral edge part of the arm plate 62.

Figure 1:
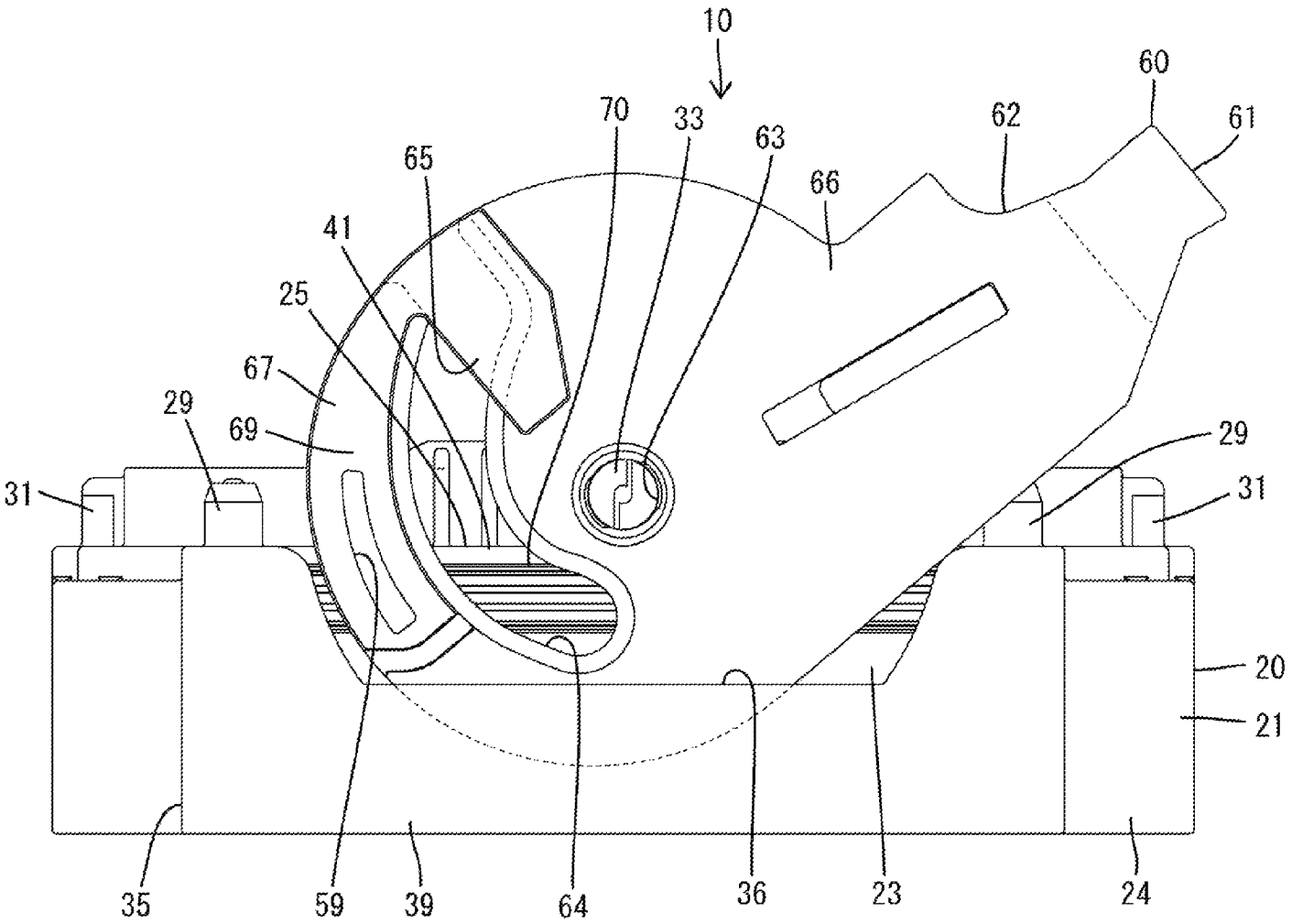
FIG. 1 is a plan view of a lever-type connector of one embodiment of the invention showing a state where a lever is at an assembled position.

As shown in FIG. 1, the lever 60 is mounted from behind to straddle the terminal accommodating portion 23 of the housing main body 21 and the shafts 33 are fit resiliently into the bearing holes 63 so that the lever 60 is supported on the housing main body 21 for rotation about the shafts 33. Specifically, the lever 60 is rotatable, relative to the housing main body 21 between an assembled position (see FIG. 1) where the coupling 61 is inclined significantly to the right, as shown, an initial position (see FIG. 2) where the coupling 61 is inclined significantly to the left, as shown, and a connection position (see FIG. 3) where the coupling portion 61 is inclined slightly to the right, as shown.

Figure 10:
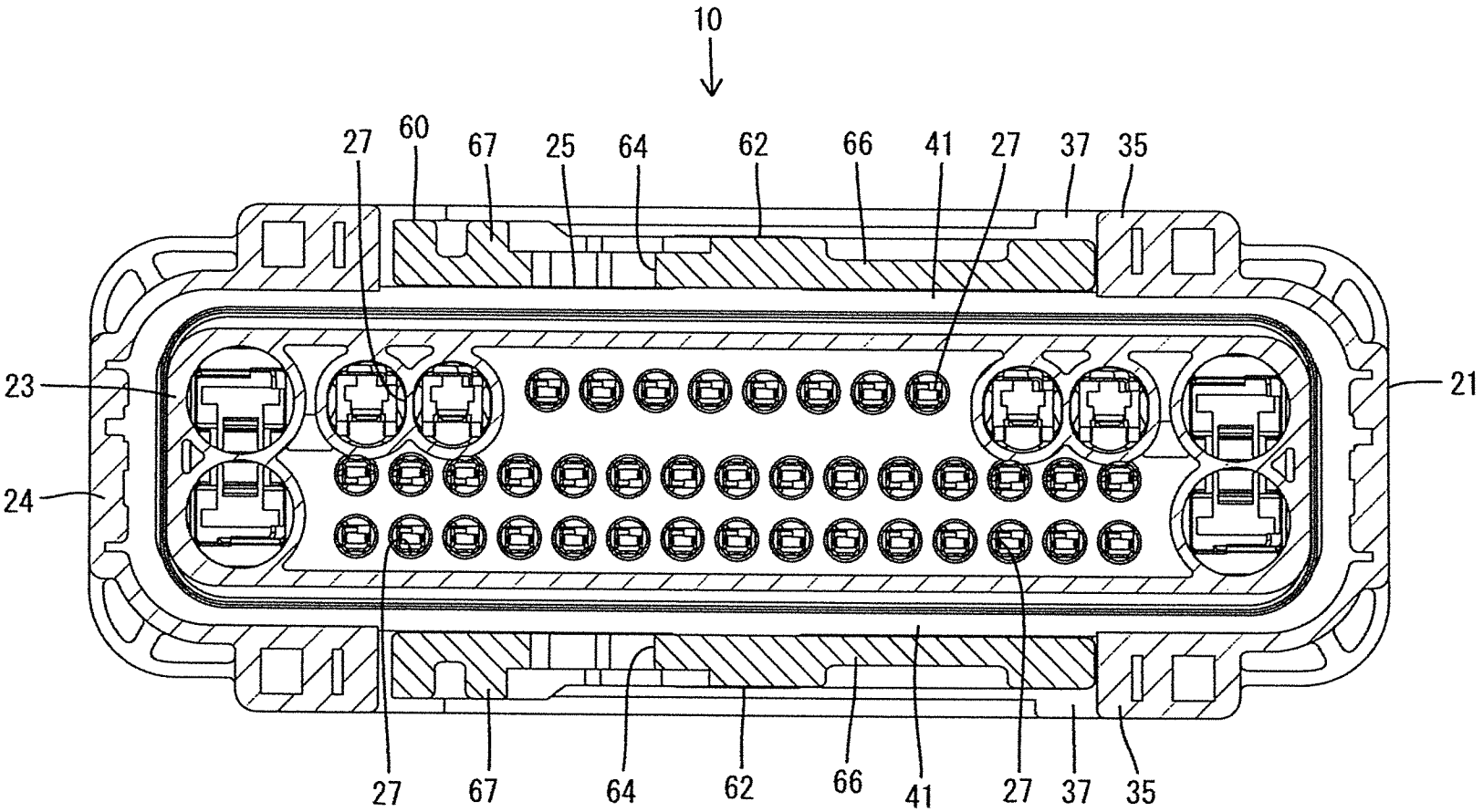
FIG. 10 is a front view in section the lever assembled with a housing main body.

When the lever 60 is assembled with the housing main body 21, the continuous panels 41 of the linking wall 25 are near inner sides of the respective arm plates 62, as shown in FIG. 10. The arm plates 62 could incline slightly inward with positions coupled to the coupling 61 as supports. However, the inwardly inclined arm plates 62 immediately contact the continuous panels 41, thereby preventing further inclination and preventing the arm plates 62 from being deflected and deformed excessively inward.

Each arm plate 62 has a thin portion 66 and a thick portion 67. The thin portion 66 is in an unhatched blank area of the arm plate 62 in FIG. 4 and is in a wide range from the coupling 61 to the outer peripheral edge of the arm plate 62.

The thick portion 67 is in the hatched area of each arm plate 62 in FIG. 4 of each arm plate 62 and has a larger plate thickness than the thin portion 66. A ratio of the thick portion 67 in the entire arm plate 62 is sufficiently smaller than the thin portion 66. As shown in FIG. 9, the thick portion 67 is thickened on an outer surface side of each arm plate 62, and the outer surface of the thick portion 67 is more outward than the outer surface of the thin portion 66. On the other hand, the inner surface of the thick portion 67 is substantially flush and continuous with the inner surface of the thin portion 66 except at a boss 68 formed on an opening edge part of the bearing hole 63. Specifically, as shown in FIG. 8, the thick portion 67 includes the bridge 65 and an extending portion 69 located between the outer peripheral edge of the arm plate 62 and the cam groove 64 and extending along the outer peripheral edge of the arm plate 62 and is arranged from the bridge 65 to a position corresponding to an intermediate position of the cam groove 64 in an extending direction. Note that a recess 59 in the form of a slit groove is formed at an intermediate position of the outer surface of the thick portion 67 in an extending direction, and a part corresponding to this recess 59 is the thin portion 66.

The lever 60 is assembled with the housing main body 21 at the assembled position, as shown in FIG. 1. During assembly, the lever 60 is mounted on the housing main body 21 before mounting the wire cover 22. At this time, the thin portions 66 of the respective arm plates 62 are inserted into the inner spaces 37 of the outward deformation preventing walls 35 and relatively large clearances are formed between the covering walls 39 of the outward deformation preventing walls 35 and the thin portions 66. The arm plates 62 interfere with the shafts 33 during assembly and deform outward with the positions coupled to the coupling 61 as support points. At this time, the thin portions 66 of the arm plates 62 are deformed outward within the ranges of the clearances, thereby avoiding the interference between the thin portions 66 and the covering walls 39. Further, even if the thin portions 66 interfere with the covering walls 39, sliding resistance does not become particularly large since the amount of interference is small. In this way, the lever 60 is assembled at the assembled position with good efficiency.

The absence of the wire cover 22 on the housing main body 21 at the assembled position enables the coupling 61 of the lever 60 to be inclined a large amount to the right side as shown in FIG. 1. Further, at the assembled position, the thick portions 67 are located behind and at a distance from the straight rear edges of the escaping portions 36 of the outward deformation preventing walls 35. Furthermore, at the assembled position, the recessed inner sides of the escaping portions 36 and the cam grooves 64 of the lever 60 are arranged to communicate in the height direction. The seal ring 70 is mounted on the outer peripheral surface of the housing main body 21 and contact with the continuous panels 41 of the linking wall 25 can be confirmed visually from the outside through the recessed inner sides of the escaping portions 36 and the cam grooves 64. Thus, the cam grooves 64 function as confirmation windows. Note that, the seal ring 70 can be seen over the entire width in the front-back direction.

The lever 60 then is rotated to the initial position and the wire cover 22 is mounted on the housing main body 21. The coupling 61 is on the left side when the lever 60 reaches the initial position, as shown, and the entrances of the cam grooves 64 face forward and communicate with the introducing recesses 43 of the outward deformation preventing walls 35 (see FIG. 4). Further, at the initial position, the thick portions 67 of the respective arm plates 62 are in the inner spaces 37 of the outward deformation preventing walls 35 to form smaller clearances between the covering walls 39 and the thick portions 67 than at the assembled position. Furthermore, at the initial position, the seal ring 70 and the continuous panels 41 can be seen through the recessed inner sides of the escaping portions 36 and the cam grooves 64 (see FIG. 2).

The mating housing 90 then is connected lightly to the housing main body 21 so that the receptacle 91 of the mating housing 90 enters the connection space 26 of the housing 20 and the follower pins 92 are inserted into the entrances of the cam grooves 64 through the introducing recesses 43, as shown in FIG. 4. At this time, the receptacle 91 is spaced from the seal ring 70 and the seal ring 70 still can be seen.

The lever 60 then is rotated to the connection position by gripping the coupling 61. As a result, the follower pins 92 slide on groove surfaces of the cam grooves 64 and a force multiplying action works between the lever 60 and the mating housing 90 to pull the mating housing 90 toward the housing 20 with a small connecting force. The seal ring 70 is covered gradually by the receptacle 91 and a visible area of the seal ring 70 gradually decreases as the connecting operation proceeds. Further, the thick portions 67 of the arm plates 62 remain within the inner spaces 37 of the outward deformation preventing walls 35 during the connecting process. The arm plates 62 may be urged outward in response to the connecting force. However, the thick portions 67 immediately contact the covering walls 39 of the outward deformation preventing walls 35 to prevent excessive outward deformation of the arm plates 62.

Figure 5:
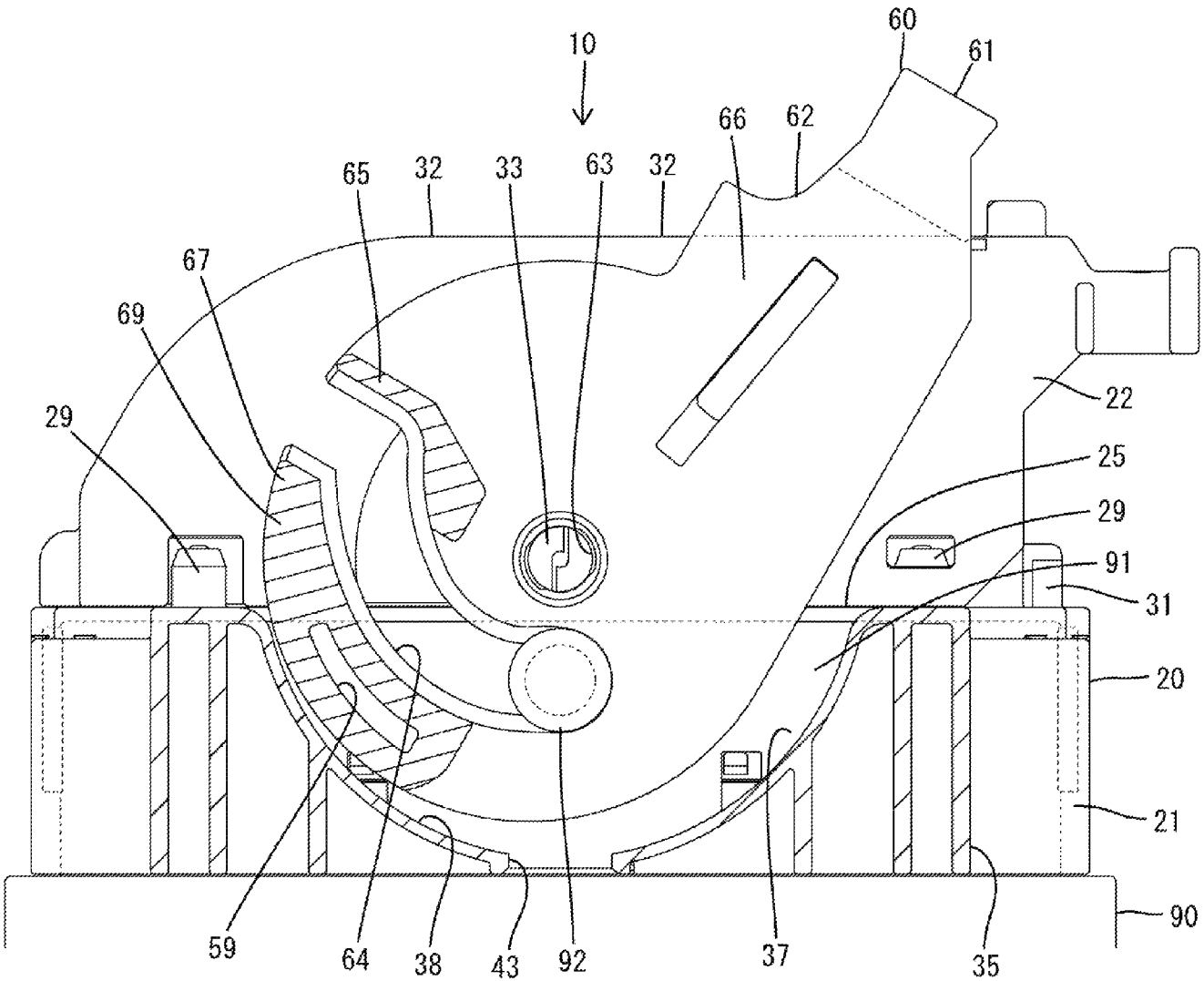
FIG. 5 is a plan view, partly in section, showing the lever at the connection position.

The coupling 61 contacts the back plate 32 of the wire cover 22, as shown in FIGS. 3 and 5, to prevent any further rotation and the follower pins 92 reach back ends of the cam grooves 64 when the lever 60 reaches the connection position. The housings 20, 90 are connected properly and each terminal fitting is connected electrically conductively to the corresponding male tab. The thick portions 67 of the arm plates 62 remain in the inner spaces 37 of the outward deformation preventing walls 35, as shown in FIG. 5, even when the lever 60 reaches the connection position. At the connection position, the receptacle 91 is stopped in contact with the linking wall 25 and the seal ring 70 is entirely covered by the receptacle 91, as shown in FIG. 3. Thus, although the receptacle 91 and the continuous panels 41 can be seen through the recessed inner sides of the escaping portions 36 and the cam grooves 64, the seal ring 70 cannot be seen. Further, at the connection position, the seal ring 70 is sandwiched resiliently between the receptacle 91 and the housing main body 21 to ensure sealing between the two housings 20, 90. Thus, if the seal ring 70 is concealed by the receptacle 91, it can be judged that the two housings 20, 90 have reached a proper connection position and sealing between the two housings 20, 90 is ensured.

The housing 20 has no wall for covering the outer side of the seal ring 70 to ensure the visibility of the seal ring 70.

Thus, no wall is in front of the shafts 33, and the front surfaces of the shafts 33 can be formed easily together with the cut recesses 42 and the introducing recesses 43 by the mold to be pulled out forward. Further, by simplifying a mold structure, a degree of freedom in forming the shafts 33 can be increased and the shafts 33 can be configured to reduce chances of fracturing.

The thin portions 66 of the arm plates 62 enter the inner spaces 37 of the outward deformation preventing walls 35 at the assembled position. Thus, sufficient escaping spaces exist for the arm plates 62 to deform out due to the interference with the shafts 33. Thus, sliding resistance due to the interference of the arm plates 62 and the outward deformation preventing walls 35 does not become excessive and assembling operability is improved. On the other hand, the thick portions 67 of the arm plates 62 enter the inner spaces 37 of the outward deformation preventing walls 35 in the process of moving the arm plates 62 from the initial position toward the connection position. Thus, the thick portions 67 prevent the arm plates 62 from lifting off the shafts 33 by reliably contacting the outward deformation preventing walls 35 when the arm plates 62 receive the connecting force for the two housings 20, 90. Therefore, operation reliability of the lever 60 is enhanced.

The inner spaces 37 of the outward deformation preventing walls 35 are sufficient to allow the thin portions 66 to deform out at the assembled position. Thus, the outward deformation preventing walls 35 need not bulge outward a large amount and the entire connector can be small.

The assembled position and the initial position of the lever 60 are different from each other. Thus, the thick portions 67 of the arm plates 62 will not enter the inner spaces 37 of the outward deformation preventing walls 35 at the assembled position.

The thin portion 66 occupies more of the arm plate 62 than the thick portion 67. Thus, the lever 60 weighs less and costs less. Furthermore, the thick portions 67 extend along the outer peripheries of the arm plates 62 to ensure rigidity of the outer peripheral edges of the arm plates 62.

The invention is not limited to the above described and illustrated embodiment. For example, the following modes also are included in the scope of the invention.

Part of the seal ring may be seen when the lever reaches the connection position. Thus, the connected state of the housings and the sealing state of the seal ring can be confirmed by managing a visible amount of the seal ring at the connection position.

If the cam grooves are bottomed grooves, the lever may have a dedicated confirmation window for confirming the state of the seal ring.

The assembled and initial positions of the lever may be the same position.

The shafts and the outward deformation preventing walls may be on the wire cover.

The thick portions may be formed by thickening inner surfaces of the arm plates or both inner and outer surface sides of the arm plates.

The lever may be a rack and pinion type or leverage type lever with no cam groove.

What is claimed is:

1. A lever-type connector, comprising:

a housing connectable to a mating housing and including shafts projecting on opposite side surfaces and outward deformation preventing walls each with an open inner space on the side of the shaft; and a U-shaped lever having a coupling and two arm plates projecting from opposite ends of the coupling, each of the arm plates having an outer periphery, a curved cam groove formed in each of the arm plates and extending from an entry at the outer periphery to a closed end inward of the outer periphery and a bearing hole penetrating each of the arm plates at a position inward from the outer periphery and spaced from the cam groove, the arm plates being assembled with the housing so that the shafts pass through the bearing holes and permit rotation of the lever between an assembled position, an initial position and a connection position, the arm plates being resiliently fit to the shafts after being deformed outward due to interference with the shafts and the lever being assembled to straddle the housing with the arm plates accommodated in the inner spaces of the outward deformation preventing walls at the assembled position, the arm plates being engaged with the mating housing at the initial position and the lever being rotated from the initial position toward the connection position while keeping an engaged state, thereby exhibiting a force multiplying action to proceed with a connecting operation of the two housings;

each arm plate including a thin portion surrounding the bearing hole and a thick portion adjacent at least the entry to the cam groove so that the thin portion enters the inner space of the outward deformation preventing wall at the assembled position and so that the thick portion enters the inner space of the outward deformation preventing wall when moving from the initial position toward the connection position and contacts the outward deformation preventing wall before the arm plate is deformed excessively out.

2. The lever-type connector of claim 1, wherein the assembled position and the initial position are set at positions different from each other.

3. The lever-type connector of claim 1, wherein the thin portion occupies more of the arm plate than the thick portion.

4. The lever-type connector of claim 3, wherein the thick portion is provided along an outer peripheral edge of the arm plate.

5. The lever-type connector of claim 1, wherein the closed end of the cam groove is at the thin portion of the respective arm plate.

6. The lever-type connector of claim 1, wherein the thin portion of each of the arm plates extends along parts of a concave side of the curved cam groove in proximity to the closed end of the cam groove.

7. The lever-type connector of claim 1, wherein the thick portion of each of the arm plates is entirely on a first side of a line that passes through the bearing hole and the closed end of the cam groove, and wherein the thin portion is disposed at least on a second side of the line that passes through the bearing hole and the closed end of the cam groove.

8. A lever-type connector, comprising:

a housing connectable to a mating housing and including shafts projecting on opposite side surfaces and outward deformation preventing walls each with an open inner space on the side of the shaft; and a U-shaped lever having a coupling and two arm plates projecting from opposite ends of the coupling, each of the arm plates having an outer periphery, a curved cam groove formed in each of the arm plates and extending from an entry at the outer periphery to a closed end inward of the outer periphery and a bearing hole penetrating each of the arm plates at a position inward from the outer periphery and spaced from the cam groove, each of the arm plates including a thin portion surrounding the bearing hole and a thick portion on surfaces of the respective arm plates that face away from one another and adjacent at least the entry to the cam groove so that the thin portion enters the inner space of the outward deformation preventing wall when assembling the lever to the housing and so that the thick portion enters the inner space of the outward deformation preventing wall when moving from an initial position toward a connection position and contacts the outward deformation preventing wall before the arm plate is deformed excessively out.

9. The lever-type connector of claim 8, wherein the closed end of the cam groove is at the thin portion of the respective arm plate.

10. The lever-type connector of claim 8, wherein the thin portion of each of the arm plates extends along parts of a concave side of the curved cam groove in proximity to the closed end of the cam groove.

11. The lever-type connector of claim 8, wherein the thick portion of each of the arm plates is entirely on a first side of a line that passes through the bearing hole and the closed end of the cam groove, and wherein the thin portion is disposed at least on a second side of the line that passes through the bearing hole and the closed end of the cam groove.

* * * * *